United States Patent [19]

Brown

[11] Patent Number: 5,052,308

[45] Date of Patent: Oct. 1, 1991

[54] FOLDABLE TABLE

[76] Inventor: James A. Brown, 1166 Coleman Rd., Cheshire, Conn. 06410

[21] Appl. No.: 440,198

[22] Filed: Nov. 22, 1989

[51] Int. Cl.[5] ..... A47B 3/02

[52] U.S. Cl. ..... 108/118; 108/115; 248/164

[58] Field of Search ..... 108/118, 115; 211/202; 297/56, 60; 248/164

[56] References Cited

U.S. PATENT DOCUMENTS

| | | | |
|---|---|---|---|
| 559,743 | 5/1896 | Ormsby | 108/118 |
| 2,197,302 | 4/1940 | Georing | 108/118 |
| 4,289,350 | 9/1981 | Thomas et al. | 108/118 |

*Primary Examiner*—Kenneth J. Dorner
*Assistant Examiner*—Gerald A. Anderson
*Attorney, Agent, or Firm*—Robert H. Montgomery

[57] ABSTRACT

A foldable work table having two pairs of legs, each pair being pivotal intermediate the ends thereof to move between a support position in a generally X-shape and a storage position where both legs of a pair are substantially parallel. The pairs of legs are longitudinally spaced apart. A first bracing member extends between each of one leg of a pair and a second bracing member extends between each of the other legs of a pair. A pair of elongated table members are hinged together along their length, each of the table members also being hinged to one of the bracing members, whereby the table members may pivot between a horizontal support position with the leg pairs in a support position and a storage position where the table members are in a generally vertical position and each leg pair is in a stowage position substantially parallel to each other. Hand holes are defined in each of the table members intermediate the ends thereof and positioned sufficiently close to the hinged edges of the table members so that both of the table portions may be grasped by one hand.

7 Claims, 3 Drawing Sheets

FOLDABLE TABLE

FIELD OF THE INVENTION

This invention relates to a portable work table which is foldable for ease of stowage.

BACKGROUND OF THE INVENTION

Foldable work tables designed primarily for carpentry use are well known. A well recognized work table is one known by the trademark "Workmate" marketed by Black & Decker Corporation. Additionally, there are many alternatives such as the use of saw horses with foldable legs. Such saw horses however, require a pair to support a work piece or a platform for a work piece.

Such saw horses may be made with foldable legs for ease of stowage. However, a saw horse per se does not provide any surface for supporting a piece to be worked upon.

Accordingly, the present invention provides a new and improved folding work table providing an upper working surface but which may also be used as a saw horse and which may be easily foldable to a stowage condition.

SUMMARY OF THE INVENTION

Briefly stated, the invention in one form thereof comprises a foldable work table having two pairs of legs, each pair being pivotal intermediate the ends thereof to move between an operative support position in a generally X-shape and a stowage position where both legs of a pair are substantially parallel. The pairs of legs are longitudinally spaced apart. A first bracing member extends between each of one leg of a pair and a second bracing member extends between each of the other legs of a pair. A pair of elongated table members are hinged together along their length, each of the table members also being hinged to one of the bracing members, whereby the table members may pivot between a horizontal support position with the leg pairs in an operative support position and a stowage position where the table members are in a generally vertical position and each leg pair is in a stowage position substantially parallel to each other. Hand holes are defined in each of the table members intermediate the ends thereof and positioned sufficiently close to the hinged edges of the table members so that both of the table members maybe grasped by one hand and the table folds to a stowage position.

An object of this invention is to provide a new and improved foldable work table.

A further object of this invention is to provide a new and improved foldable work table which may be easily placed into an operative position and which may be easily folded for stowage.

The features of the invention which are believed to be novel are particularly pointed out and distinctly claimed in the concluding portion of this specification. The invention, however, together with further objects and advantages thereof may best be appreciated by reference to the following detailed description taken in conjunction with the drawings.

DETAILED DESCRIPTION OF A PREFERRED EMBODIMENT OF THE INVENTION

Figure 1:
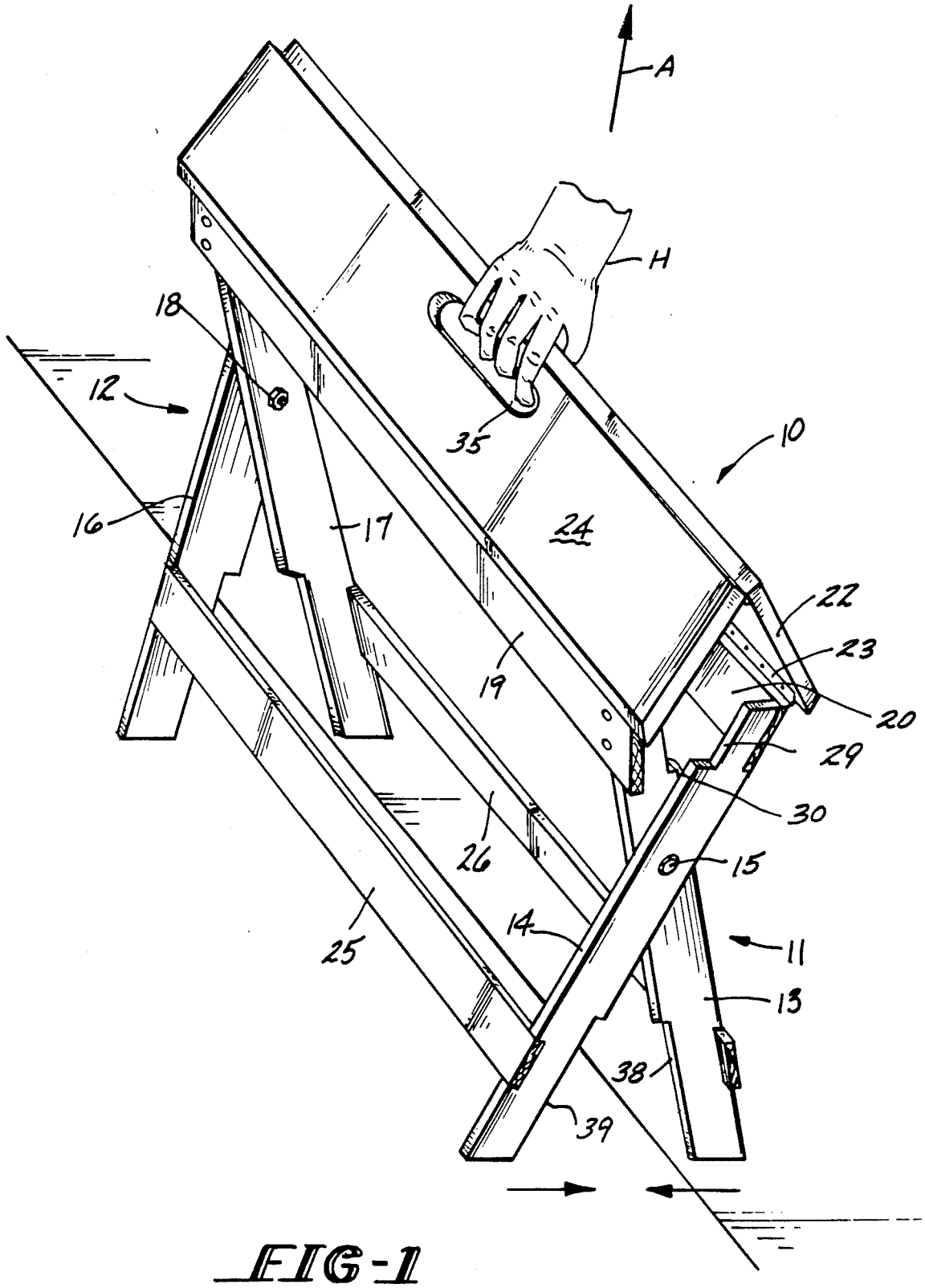
FIG. 1, is a perspective view of a work table embodying the invention shown between a folded position and an operative working position.

Reference is now made to FIG. 1 which shows a work table embodying the invention in an intermediate position between a fully operative working position and a folded position. A device 10 embodying the invention comprises at each end thereof a pair of pivotal legs 11 and 12. The leg pair 11 comprises legs 13 and 14 pivoted together intermediate the ends at 15 while the leg pair 12 comprises legs 16 and 17 pivoted together at 18.

Legs 11 and 17 are connected together by a bracing member 19 extending therebetween and legs 14 and 16 are connected together by a bracing member 20 extending therebetween as will be hereinafter more fully described. A first table member 22 is connected to bracing member 20 as by means of an elongated hinge 23. A second table member 24 is hingedly connected to bracing member 19, by an elongated hinge 27. Also, the table members 22 and 24 are hingedly connected at their adjacent sides.

All of the legs 13, 14, 16 and 17 are preferably identical. A lower bracing member 25 interconnects legs 14 and 16 and another lower bracing member 26 interconnects legs 13 and 17. All bracing members are troughed into the legs, as shown in the drawings.

Figure 2:
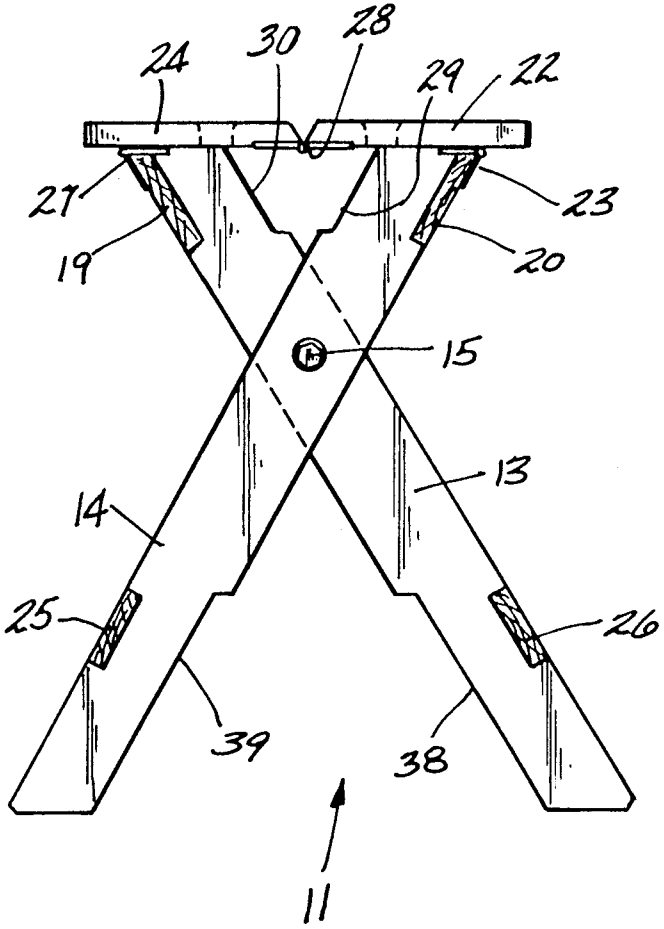
FIG. 2, is an end elevation of the device of FIG. 1 shown in a operative working position.

As shown in FIG. 2, the hinge connecting table member 24 with bracing member 19 is identified by the reference numeral 27. The hinge connecting table members 22 and 24 is identified by the reference numeral 28. The hinge connecting bracing member 20 with table member 22 is identified by the reference numeral 23.

The legs are recessed at the upper portion thereof at 29 for leg 14 and at 30 for leg 13 as shown in FIG. 1. Legs 16 and 17 are similarly recessed to receive the bracing members 19 and 20 respectively when the worktable is folded as shown in FIG. 3.

It will be noted from FIG. 1 that bracing member 19 extends beyond leg 13 and will be received within recess 29 of leg 14 in the stowed position. Recess 30 in leg 13 receives bracing member 20. This provides a stopping position of the legs pairs when folded to the position shown in FIG. 3, and further prevents any over extension of the hinges.

Figure 3:
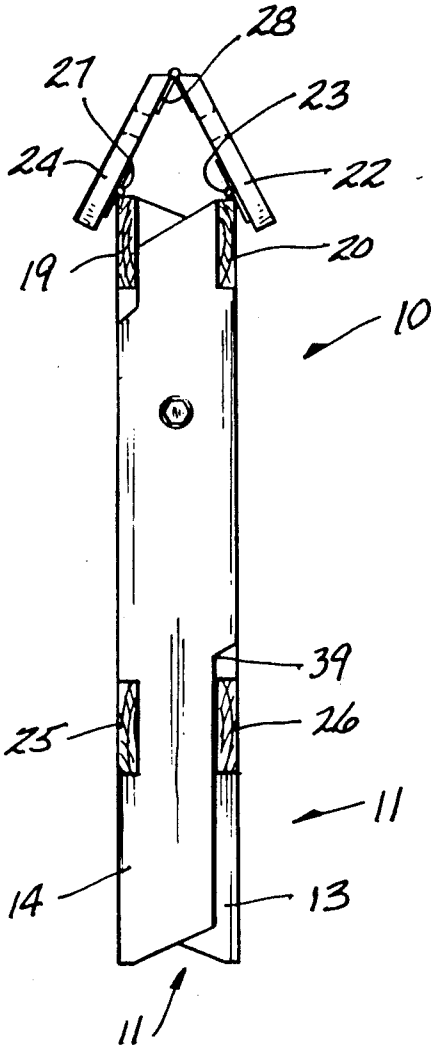
FIG. 3, is an end elevation of the device of FIGS. 1 and 2 showing the device in a folded position.

In this manner, the leg pairs 11 and 12 at each end of the work table will be in an essentially parallel position when the table is folded to the position of FIG. 3.

Figure 4:
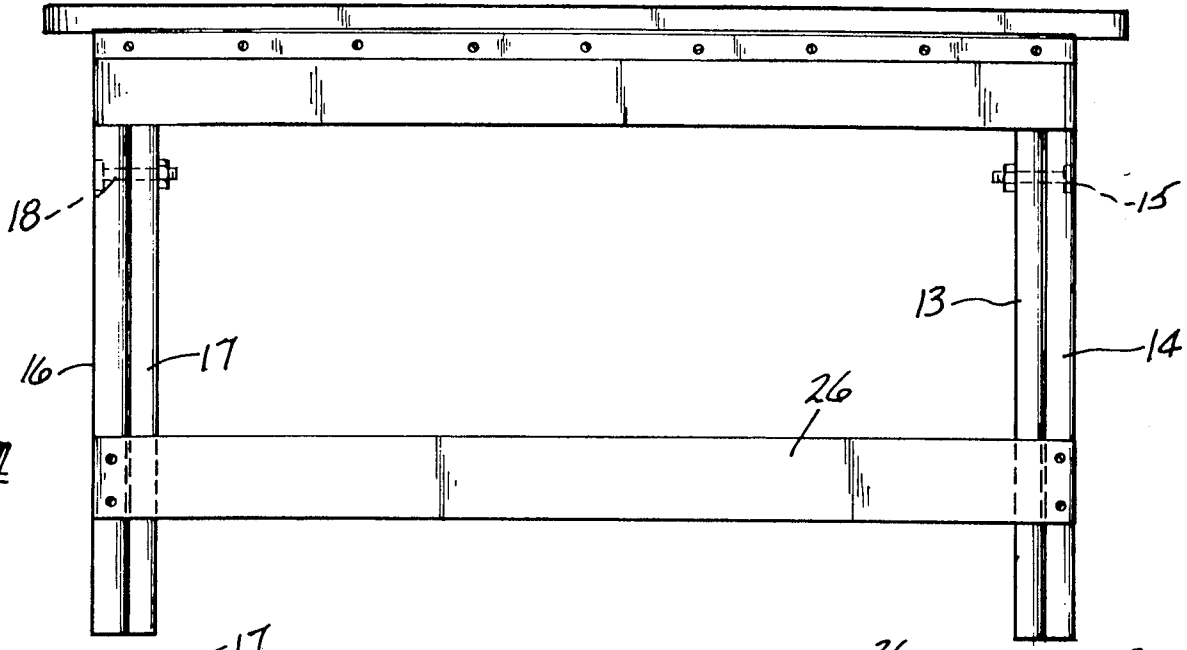
FIG. 4, is a front elevation of a work table embodying the invention showing the work table in an operative working position.
Figure 5:
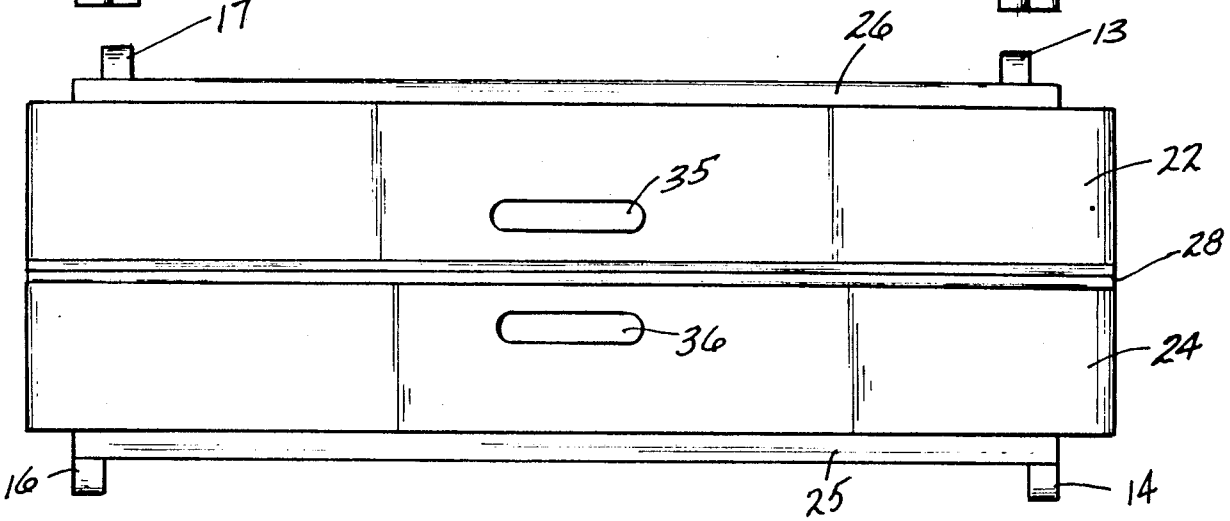
FIG. 5, is a planned view of the work table of FIG. 4 when in an operative working position.

Reference is now made to FIGS. 4 and 5. Each of table members 22 and 24 have hand holds 35 and 36 defined therein closely adjacent the edges of members 22 and 24 which are connected by hinge 28. The hand holds 35 and 36 are centrally of the lengths of the table members.

With reference to FIG. 1, when the user grasps hand holds 35 and 36 as by hand H and pulls upwardly thereon as indicated by arrow A the table members 22 and 24 will pivot with respect to hinge 28. Similarly, the table members 22 and 24 will pivot about hinges 23 and 27 to move the members of the work table including the legs to the position as shown in FIG. 3.

When it is desired to put the work table into an operative position, the user merely grasps the hand holds 35 and 36 and places legs 17 and 13 on a surface or alternatively legs 14 and 16 on a surface with the other legs slightly elevated and then pushes down on the table members 22 and 24 by way of their hand holds to move the work table to an operative working position as shown in any of FIGS. 2, 4 or 5.

It may thus be seen that a device embodying the invention is easily converted from an operative position to provide a work surface for carpentry or other work and is easily converted to a foldable position for stowage when use of the work table is not desired.

As shown in FIGS. 2 and 3, the legs 13 and 14 have recesses or are relieved such that when the work table is folded to the inoperative stowage position shown in FIG. 3, recess 38 receives therein bracing member 25 while recess 39 receives therein bracing member 26. While this is only illustrated with respect to one end or one pair of legs 11 of the work table it is equally true with respect to the other pair of legs 12.

A work table embodying the invention requires only a minimal number of identical parts. The bracing members 19, 20, 25 and 26 may all be of the same length and width. The four legs 13, 14, 16 and 17 are identical as are the upper bracing members 19 and 20. Also the table members 22 and 24 are of the same size and are identical. However, bracing members 19 and 20 are angled at the upper edges thereof for the purpose of providing horizontal upper edges when the work table is in an operative working position Preferably the hinges described are of the piano type and extend the length of the table members and the bracing members 19 and 20.

A work table embodying the invention has been prototyped in wood. However, the work table may be made of other materials or combinations of materials. Examples are thermoplastic injection molding, glass or carbon fiber molded, in resin, or metal stamping or casting. A work table embodying the invention requires only four different parts and is suitable for high volume production.

It may thus be seen that the objects of the invention set forth, as well as those made apparent from the foregoing description, are efficiently attained. While a preferred embodiment of the invention has been set forth for purposes of disclosure, modification to the disclosed embodiment of the invention, as well as other embodiments thereof, may occur to those skilled in the art. Accordingly, the appended claims are intended to cover all embodiments of the invention and modifications to the disclosed embodiments which do not depart from the spirit and scope of the invention.

What is claimed is:

1. A collapsible table comprising two pairs of legs, each pair being pivotal intermediate the ends thereof to move between a support position in a generally X-shape and a stowage position where both legs of a pair are substantially parallel, said pairs of legs being spaced apart, a first bracing member extending between each of one leg of pair at the upper ends thereof, a second bracing member extending between each of the other legs of a pair at the upper ends thereto, and a pair of elongated table members having adjacent edges and outer edges, said table members being hinged together by a elongated hinge along the length of said adjacent edges, each of said table members being hinged by a elongated hinge to one of said bracing members along their outer edges whereby said table members may pivot between a horizontal support position with said leg pairs in a support position and a stowage position where said table members are in a generally vertical position and said leg pairs are in said stowage position, and handholds defined in said table members intermediate the ends thereof and positioned sufficiently close to the hinged adjacent edges of said table members so that both of said table members maybe grasped by one hand and pivot said table members about the hinging thereof to move said table to a stowage position.

2. The table of claim 1 where third and fourth bracing members extend between each of one leg of a pair adjacent the lower ends thereof.

3. A collapsible table comprising two pairs of legs, each pair being pivotally connected intermediate the ends thereof to move between a support position in a generally X-shape and a stowage position where both legs of a pair are substantially parallel, said pairs of legs being spaced apart, a first bracing member extending between each of one leg of a pair at the upper ends thereof, a second bracing member extending between each of the other legs of a pair at the upper ends thereof, a pair of elongated table members having adjacent edges and outer edges, said table members being hinged together by a elongated hinge along their adjacent edges, each of said table members being hinged by a elongated hinge to one of said bracing members along their outer edges, whereby said table members may pivot between a horizontal support position with said leg pairs in a support position and a stowage position where said table members are both in a generally vertical position and said leg pairs are in said stowage position, and hand holes defined in said table members intermediate the ends thereof and positioned sufficiently close to the hinged adjacent edges of said table members so that both of said table members may be grasped by one hand.

4. The table of claim 3 where third and fourth bracing members extend between each of one leg of a pair adjacent the lower ends thereof.

5. The table of claim 3 where the hand holds are defined in said table portions centrally of the lengths thereof.

6. A collapsible table comprising two pairs of legs, each pair being pivotal intermediate the ends thereof to move between a support position in a generally X-shape and a stowage position where both legs of a pair are substantially parallel, said pairs of legs being spaced apart, a first bracing member extending between each of one leg of a pair at the upper ends thereof, a second bracing member extending between each of the other legs of a pair at the upper ends thereto, said bracing members being essentially parallel and a pair of elongated table members having adjacent and outer edges, said table members being pivotally connected together by a elongated hinge along their length at said adjacent edges, each of said table members, being pivotally connected along their length by a elongated hinge at their outer edges to one of said bracing members, whereby said table members may pivot between a horizontal support position with said leg pairs in a support position and a stowage position where said table members are in a generally vertical position and said leg pairs are in said stowage position, and hand holds are defined in said table members intermediate the ends thereof and positioned sufficiently close to the pivotally connected adjacent edges of said table members so that both of said table members maybe grasped by one hand and pivot said table members about the pivotal connection thereof to move said table to a stowage position.

7. The work table of claim 6 where third and forth bracing members extend between each of one leg of a pair adjacent the lower ends thereof.

* * * * *